US006053585A

United States Patent [19]

Osen

[11] Patent Number: 6,053,585

[45] **Date of Patent: *Apr. 25, 2000**

[54] INTERCHANGEABLE PANEL AND CABINET FRONT FOR A CABINET

[75] Inventor: John P. Osen, 25884 Mary, Chesterfield, Mich. 48051

[73] Assignees: John P. Osen, Chesterfield Township; Thomas C. Gnesda, Clinton Township, both of Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 09/014,020

[22] Filed: Jan. 27, 1998

[51] Int. Cl.[7] ..... A47B 97/00

[52] U.S. Cl. ..... 312/204; 40/611

[58] Field of Search ..... 312/204, 234.3, 312/348.4, 234.1; 52/455; 49/501; 40/611, 765, 775, 649

[56] References Cited

U.S. PATENT DOCUMENTS

| | | | |
|---|---|---|---|
| 2,706,139 | 4/1955 | Jabczenski . | |
| 3,186,027 | 6/1965 | Merillat . | |
| 3,697,363 | 10/1972 | Martinez . | |
| 3,826,551 | 7/1974 | Schwartz | 312/204 X |
| 4,046,438 | 9/1977 | Benasutti et al. . | |
| 4,158,277 | 6/1979 | Krempp et al. . | |
| 4,229,921 | 10/1980 | Schell . | |
| 4,732,431 | 3/1988 | Mason . | |
| 5,141,300 | 8/1992 | Ciesla | 312/204 |
| 5,158,346 | 10/1992 | Marks et al. . | |
| 5,547,272 | 8/1996 | Paterson et al. . | |
| 5,571,276 | 11/1996 | Kobos et al. . | |
| 5,603,558 | 2/1997 | Zimmer . | |
| 5,791,752 | 8/1998 | Hartman | 312/204 |

FOREIGN PATENT DOCUMENTS

| | | | |
|---|---|---|---|
| 0079873 | 5/1983 | European Pat. Off. | 312/204 |
| 27 313 97 | 10/1978 | Germany | 312/204 |
| 32 052 32 | 8/1983 | Germany | 312/204 |
| 2005536 | 4/1979 | United Kingdom | 312/204 |

*Primary Examiner*—Peter M. Cuomo
*Assistant Examiner*—Hanh V. Tran
*Attorney, Agent, or Firm*—Bliss McGlynn, P.C.

[57] ABSTRACT

A cabinet front for a cabinet includes a generally planar base portion and a frame portion having a recessed portion and a securing portion, wherein the securing portion is fixedly mounted to the base portion. A channel is formed between the frame portion, the securing portion and the base portion. The cabinet front includes a reversible, decorative panel slidably positioned within the channel.

10 Claims, 1 Drawing Sheet

INTERCHANGEABLE PANEL AND CABINET FRONT FOR A CABINET

BACKGROUND OF THE INVENTION

1. Field of the Invention

The present invention relates generally to cabinets and, more particularly, to an interchangeable panel and cabinet front for a cabinet.

2. Description of the Related Art

A furniture cabinet is well known to include a base structure and a cabinet front. The cabinet front may be a door for providing access into the interior of the cabinet or a drawer. The cabinet, as is well understood in the art, may be free-standing, such as for an entertainment center, or built-in, such as in a kitchen. Oftentimes, the front of the cabinet, including the door, is decorative in appearance. This may be accomplished through a variety of artistic techniques, including decorative moldings, colors, textures or patterns. A decorator may want to change the appearance of the cabinet front, for example, to coordinate with other furnishings. Therefore, there is a need in the art to provide an interchangeable and reversible panel for a cabinet front that is simple enough for the consumer to install with common hand tools.

SUMMARY OF THE INVENTION

It is, therefore, one object of the present invention to provide an interchangeable panel and cabinet front for a cabinet.

It is another object of the present invention to provide reversible panel for a cabinet front.

To achieve the foregoing objects, the present invention is a cabinet front for a cabinet. The cabinet front includes a generally planar base portion. The cabinet front also includes a frame portion having a recessed portion and a securing portion, wherein the securing portion is fixedly mounted to the base portion to form a channel between the frame portion, the securing portion and the base portion. The cabinet front further includes a reversible, decorative panel slidably positioned within the channel.

One advantage of the present invention is that a panel is provided for a cabinet front that is simple to remove and reinstall. Another advantage of the present invention is that a reversible panel is provided for a cabinet front that is decorative in appearance on both sides.

Other objects, features and advantages of the present invention will be readily appreciated as the same becomes better understood after reading the subsequent description when considered in connection with the accompanying drawings.

DESCRIPTION OF THE PREFERRED EMBODIMENT(S)

Figure 1:
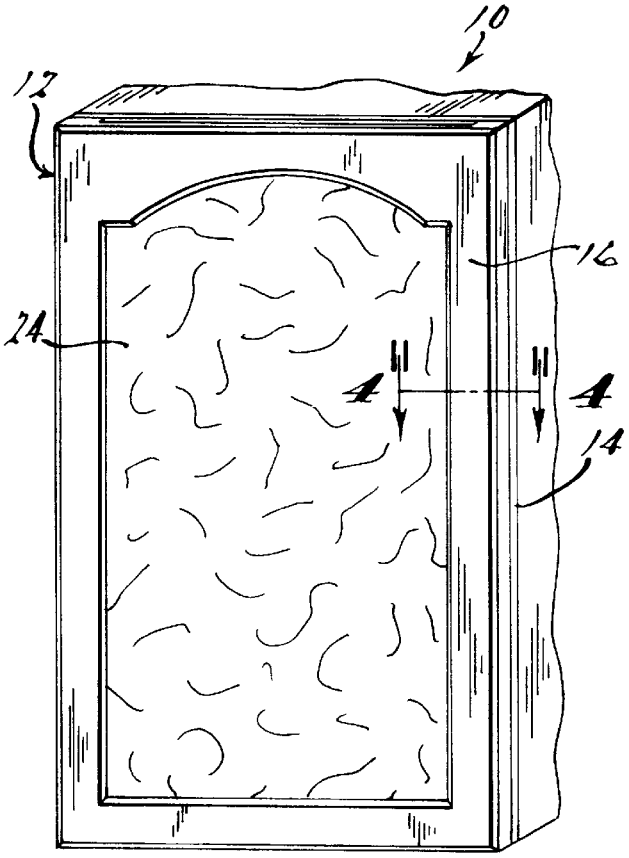
FIG. 1 is a perspective view of a cabinet front for a cabinet, according to the present invention.
Figure 2:
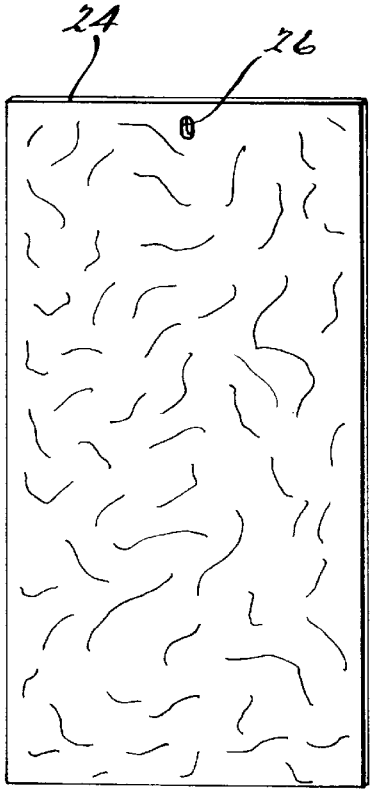
FIG. 2 is a perspective view of a panel, according to the present invention, for the cabinet front of FIG. 1.
Figure 3:
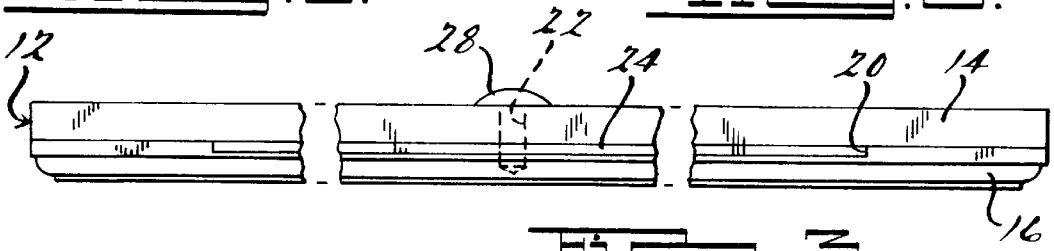
FIG. 3 is a top view of the cabinet front of FIG. 1.
Figure 4:
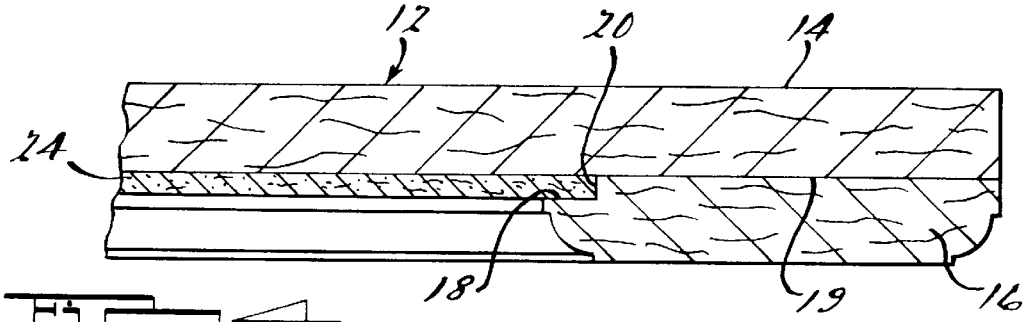
FIG. 4 is a sectional view taken along line 4—4 of FIG. 1 illustrating the panel in an installed position on the cabinet front.

Referring to FIGS. 1 through 4, one embodiment of a cabinet front 12, according to the present invention, is illustrated in operational relationship with a cabinet 10. It should be appreciated that, in this example, the cabinet 10 is of a built-in type usually associated with an upper cabinet, although other types of furniture cabinets may be used with the present invention.

The cabinet 10 is preferably a box-shaped structure, that is open on a side to provide access into the interior space of the cabinet 10 as is known in the art. The cabinet 10 also includes a cabinet front 12, according to the present invention, for enclosing the cabinet 10. In this example, the cabinet front 12 is mounted by a hinge (not shown) to the cabinet 10 and is in the form of a door. The hinge is of a memory type such that a gap between the door and cabinet is constant and will not bind. However, it should be appreciated that the cabinet front 12 may slidably mounted to the cabinet 10 and in the form of a drawer (not shown). It should be appreciated that the hinge (not shown) may be either one of the concealed type or the revealed type, as is well known in the art.

The cabinet front 12 includes a generally planar base portion 14 having a surface 15 providing an appearance. The base portion 14 includes a frame portion 16 fixedly mounted by suitable means such as adhesive and dowels about a perimeter of an exterior surface of the base portion 14. Preferably, the frame portion 16 is decorative in shape, such as the cathedral style shown, but may be of any suitable shape. The base portion 14 and frame portion 16 are generally rectangular in shape. Preferably, the base portion 14 and frame portion 16 are of a rigid material such as a wood-type material commonly used in furniture making, such as particle board.

The cabinet front 12 includes an interior surface of the frame portion 16 divided into a recessed portion 18 and a securing portion 19. The recessed portion 18 is generally U-shaped, so as to form a channel or slot 20 between the interior surface of the frame portion 16 and the base portion 14. The cabinet front 12 also includes a decorative panel 24, according to the present invention, retained in the channel 20, in a manner to be described. It should be appreciated that, in this example, the channel 20 extends to an upper edge of the frame portion 16. Likewise, for a cabinet 10 such as a base cabinet, the shape of the channel 20 would be inverted, extending to a lower edge of the frame portion 16, so it is not visible. Similarly, the channel 20 extends to a lower edge of the frame portion 16 when the cabinet front 12 is in the form of a drawer so it is not visible.

The base portion 14 also includes an opening 22 for securing the panel 24 to the base portion 14, in a manner to be described. In this example, the opening 22 is centered near an upper edge of the cabinet front 12. Similarly, in the example of a base cabinet, the opening 20 would be centered near a lower edge of the cabinet front 12.

The cabinet front 12 also includes the panel 24 removably positioned between the frame portion 16 and the base portion 14. The panel 24 is generally rectangular, planar, reversible and interchangeable with another panel 24. Preferably, the panel 24 is made of two sheets 25*a* of a laminate material, with each sheet secured together back to back, such as with an adhesive 25*b*, allowing each visible side of the panel 24 to present a unique decorative image. For example, each side of the panel 24 could display a separate color or pattern. In this example, the panel 24 is 3/32 (inch) thick.

The panel 24 is slidably positioned into the channel 20 formed between the base portion 14 and the frame portion 16. In this example, the panel 24 is inserted into the channel

20 beginning at the upper edge of the cabinet front 12. This arrangement is preferred for an upper cabinet, where the channel 20 is not visible. The panel 24 also includes an elongated opening 26 positioned relative to the opening 22 in the base portion 14. To fixedly retain the panel 24 within the channel 20, a retaining mechanism 28 is secured through the opening 22 in the base portion 14 and the elongated opening 26 in the panel 24. An example of a retaining mechanism 28 is a screw. In this example, the screw 28 extends ⅝ (inch) through the base portion 14, panel 24 and partially through the frame portion 16.

Additionally, the cabinet front 12 may include a barrier (not shown) on one side of the base portion 14 between the base portion 14 and frame portion 16. The barrier is made of a material such as contact paper to protect the base portion 14 from moisture and provide a colored surface when the panel 24 has been removed. The barrier also allows the panel 24 to slide better in the channel 20.

To remove or reverse the panel 24, the cabinet front 12 may have to be removed from the cabinet. The retaining mechanism 28 is removed, such as by unscrewing and removing the screw 28. The panel 24 is then slidably removed from the channel 20. The panel 24 may then be reversed or interchanged and inserted into the cabinet front 12 as previously described.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A removable cabinet front for a cabinet comprising:

a generally planar solid base portion for concealing an interior of the cabinet and adapted to be removed from the cabinet;

a frame portion having a recessed portion and a securing portion, wherein said securing portion is fixedly mounted to said base portion to form a channel between said recessed portion, said securing portion and said base portion; and a reversible, decorative, panel comprising two sheets of a laminate material, with each of said sheets secured together back to back with an adhesive, said panel being slidably positioned within said channel; and a retaining mechanism extending through said base portion and said panel to fixedly retain said panel within said channel, wherein said panel has a first surface providing a first appearance and a second surface providing a second appearance and said base portion having a third surface providing a third appearance when said panel is removed.

2. A cabinet front as set forth in claim 1 wherein said panel is made from a plurality of laminate sheets secured together.

3. A cabinet front as set forth in claim 2 wherein said laminate sheets are secured together using an adhesive.

4. A cabinet front as set forth in claim 1 wherein said channel extends up to an upper edge of said cabinet front for installing and removing said panel.

5. A cabinet front as set forth in claim 1 wherein said channel extends down to a lower edge of said cabinet front for installing and removing said panel.

6. A cabinet front as set forth in claim 1 wherein said retaining mechanism is a screw passing through an opening in said base portion and a corresponding elongated opening in said panel and partially into said frame portion.

7. A removable cabinet front for a cabinet comprising:

a generally planar solid base portion for concealing an interior of the cabinet and adapted to be removed from the cabinet;

a frame portion having a recessed portion and a securing portion, wherein said securing portion is fixedly mounted to said base portion to form a channel between said recessed portion, said securing portion and said base portion;

a reversible, decorative, panel comprising two sheets of a laminate material, with each of said sheets secured together back to back with an adhesive, said panel being slidably positioned within said channel between said frame portion and said base portion, wherein said panel is made from a plurality of laminate sheets secured together and having a first surface providing a first appearance and a second surface providing a second appearance and said base portion having a third surface providing a third appearance when said panel is removed; and a retaining mechanism extending through said base portion and said panel for fixedly retaining said base portion, said panel and said frame portion together.

8. A cabinet front as set forth in claim 7 wherein said channel extends up to an upper edge of said cabinet front for installing and removing said panel.

9. A cabinet front as set forth in claim 7 wherein said channel extends down to a lower edge of said cabinet front for installing and removing said panel.

10. A cabinet front as set forth in claim 7 wherein said retaining mechanism is a screw passing through an opening in said base portion and a corresponding elongated opening in said panel and partially into said frame portion.

* * * * *